United States Patent [19]

Martin

[11] 4,106,489

[45] Aug. 15, 1978

[54] DEVICE TO STRENGTHEN MUSCLES

[76] Inventor: Kenneth W. Martin, 934 Fourth St. NE., Pulaski, Va. 24303

[21] Appl. No.: 742,093

[22] Filed: Nov. 16, 1976

[51] Int. Cl.[2] ..... A61B 19/00

[52] U.S. Cl. ..... 128/1 R; 128/2 S; 128/341

[58] Field of Search ..... 128/2 S, 79, 341, 343, 128/303.11, 1 R; 272/67, 94, 95, 119, 126, 135, 137, 140, 143, 145, 77, 78; 46/32

[56] References Cited

U.S. PATENT DOCUMENTS

| | | | |
|---|---|---|---|
| 787,920 | 4/1905 | Hofmann | 128/303.12 X |
| 821,783 | 5/1906 | Clease | 272/137 |
| 1,928,893 | 10/1933 | Hoard | 128/341 |
| 2,541,520 | 2/1951 | Kegel | 128/2 S |
| 2,594,097 | 4/1952 | Twyman | 128/79 X |
| 2,721,549 | 10/1955 | Ferraro | 128/341 X |
| 2,759,478 | 8/1956 | Boltuch et al. | 128/341 |
| 3,502,328 | 3/1970 | Hamilton | 272/137 |
| 3,966,204 | 6/1976 | Dubach | 272/135 |
| 4,050,449 | 9/1977 | Castellana et al. | 128/79 X |

*Primary Examiner*—Robert W. Michell
*Assistant Examiner*—Michael H. Thaler
*Attorney, Agent, or Firm*—William F. Frank

[57] ABSTRACT

A device for increasing the muscular strength of certain muscles within the vaginal region of the human body. The device includes means whereby the user is enabled to increase a radial type pressure as an axial withdrawal force is applied to the device by resilient means which are controlled by the user.

4 Claims, 4 Drawing Figures

DEVICE TO STRENGTHEN MUSCLES

BACKGROUND OF THE INVENTION

This particular invention relates to those devices which have a therapeutic enhancement in the development of certain muscular strenghts in the vaginal region of the female body. More specifically, the present invention provides a device which is able to enhance the creation of a normal radial pressure against the therapeutic element by enabling the user to control the force of an withdrawal motion which is axially directed against the radial pressure normally provided by the vaginal muscles.

BACKGROUND OF THE INVENTION AND THE PRIOR ART

The present invention is more related to the therapeutic application of measures which enhance, repair or develop certain type of sphincter type muscles within the human body. More specifically, the present invention relates to the development of, or recovery of, strength in the sphincter type muscles as related to the female body. History has shown that under certain conditions such as physical violation of the vaginal region through the aspect of a rape or the controlled physical violation and, possible in certain instances, destruction of the muscular elements surrounding the vagina in childbirth that injuries occur which, again based upon medical history, can be repaired through proper exercise of the muscles surrounding the vaginal region of the female body. The muscles involved are by design most normally of a rather circular or encompassing nature. In other words, any reaction from these muscles is of an inwardly directed radial pressure. In the instance of rape for example, there may be a tearing or distortion of the relationship of these circularly arranged muscles and likewise in the course of birth there may be again a distortion or damage to these muscles.

There have been numerous efforts to provide means including a device and a method for restoring the muscular tone of these muscles no matter what the reason for their distortion. For example, U.S. Pat. No. 2,507,858 discloses a device to be inserted into the vaginal area which attempts to teach, by the physical, voluntary action of the patient, contraction of the muscles in the vaginal area by a creation of certain radial pressures. U.S. Pat. No. 3,926,178 discloses a more sophisticated system for the development of the strength or the return of the strength of the sphincter type muscles in the vaginal area wherein the pressure within that area along the well known zones of pressure can be indicated so as to indicate to the user whether or not the user is fully exercising the constrictive powers of these sphincter type muscles. U.S. Pat. No. 3,726,273 discloses another type device for determining the ability of the user to constrict the related sphincter type muscles in the vaginal area to produce certain degrees of strength.

It is also recognized among certain groups of marriage counsellors that the ability of the vagina to provide a radially constrictive pressure, whether it be simultaneously directed in all regions of the vagina or possibly in a sequence of divided areas out of the vaginal area due to the actual structural organization of the muscles surrounding the vaginal area, produces a possible enhancement of certain relationships within the physical engagement of man and woman. These prior devices are respectively directed toward the latter aspect of control of muscles in the vaginal area have been indicated to be of possible therapeutic enhancement in the physical relationship between man and woman.

All the foregoing devices are related only to the ability, or the teaching of the ability, to produce a constrictive radial type pressure. One cannot fault such procedure since, as previously described, the prior art teaches only the application of a inwardly directed radial type pressure by the sphincter type series of muscles within the vaginal cavity. The present invention provides an additional form of pressure which must be resisted by these muscles.

When one considers the normal aspect of the relationship between male and female it must be recognized that there is a certain axial type movement which is conducted within the vaginal area. This activity is possibly considered most aptly as a reciprocal type movement. Thus, in such movement there is normally considered to be only a radially directed constrictive muscular tension on the part of the female while at the same time there is a diametrically axially opposed muscular reaction on the part of the male. This direction on the part of the male partner normally produces a force of withdrawal which is perpendicularly directed to the normal constrictive and radially inwardly directed force which can be exerted by the female partner.

The present invention therefore provides a means for the development of additional strength within the female sphincter muscles encircling the vaginal area which is not contemplated by the prior art nor in any way suggested thereby.

SUMMARY OF THE PRESENT INVENTION

The present invention provides a means whereby the user of the invention, a female, is enabled to provide a resistive force perpendicular to the normal sphincter contraction force inherent within the female physiology, particularly in the vaginal area. The means whereby the axial force is generated is controlled by the user and consists of resilient members attached to another member or means which is insertable by the female into the vaginal area and to which the user can apply the conventional constrictive radially inwardly directed muscular pressures. The present device provides for the addition of a axially directed, amounting to a withdrawal force type, force which is presented to the user. The amount of withdrawal force which can be directed toward the present device is at the pleasure or choice of the user. The intent of the present invention is to progressively develop and increase the withdrawal force against which the sphincter type muscles must be able to react.

DESCRIPTION OF THE INVENTION AS SHOWN IN THE ILLUSTRATIVE DRAWINGS

The invention may be seen in the following drawing figures which are illustrative of two embodiments of the invention as well as embodiments of certain components of the invention. The drawings are not to be construed as in any way limiting the scope of the invention. It will be clearly understood and recognized by those of skill in the art that the physical embodiments of the invention may be modified as to particular structure and composition without departing from the scope of the invention as set forth in the appended claims.

DETAILED DESCRIPTION OF THE INVENTION

Figure 1:
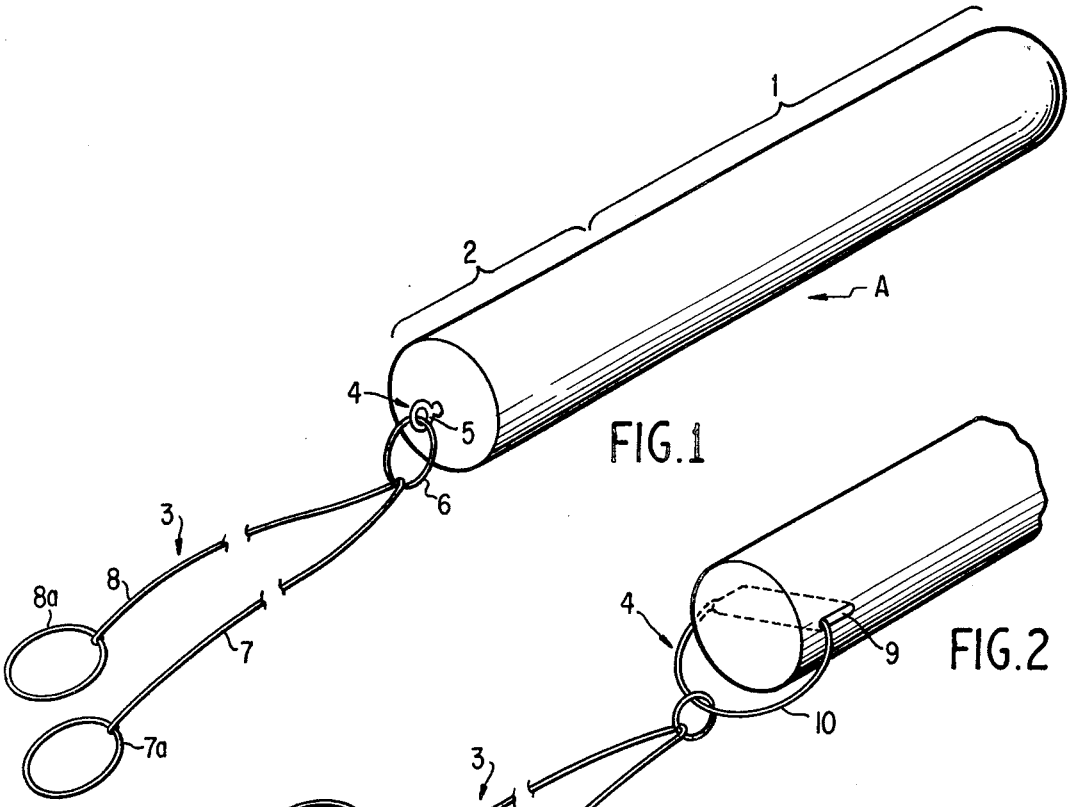
FIG. 1 is a perspective view of one embodiment of the present invention.

As seen in FIG. 1, the device A comprises a penile shaped element which is of a diameter between 1 and 1½ inches and of cylindrical form with one flat end and one hemispherical end. The length of the device seen in FIG. 1 may be variable in a sense that it can range from 6 to 10 or more inches at the option of the manufacturer. The embodiment shown in FIG. 1 comprises a fore portion 1 and a base portion 2. Tensioning means 3 are secured to the base portion 2 by a securing means 4.

The tensioning means 3 comprises a loop of elastic material 6 to which are attached two cords 7 and 8 each terminating in a respective loop 7*a* and 8*a*. In the embodiment shown in FIG. 1, the securing means 4 comprises an eye element 5 which is inserted into the flat end of base portion 2.

Figure 2:
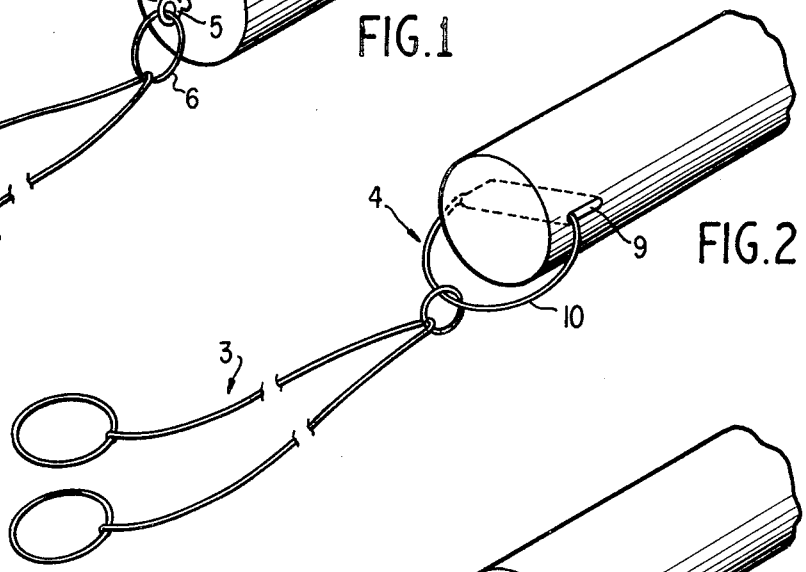
FIG. 2 is a perspective of a portion of the invention seen in FIG. 1 showing different attachment means for the tensioning means.

An embodiment as shown in FIG. 2 discloses a tensioning means 3 which is substantially identical to that same tensioning means 3 described with reference to FIG. 1. The attachment means 4 as seen in FIG. 2 comprises a slot 9 which passes through the lower part of the base portion 2 and through which is attached a loop 10 made of cord-like material.

Figure 3:
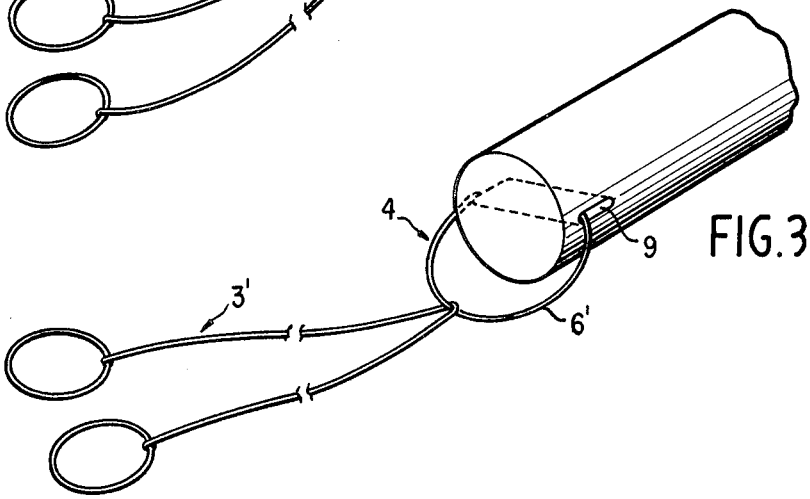
FIG. 3 is a perspective of a portion of the invention seen in FIG. 2 showing yet another embodiment for attaching tensioning means.

In the embodiment shown in FIG. 3, the attachment means 4 comprise a slot 9 through which is passed a loop of resilient material 6′. The tensioning means 3′ is attached to the loop 6′ as seen generally in FIGS. 1 and 2.

It is within the scope of the present invention that the tensioning means 3 may be formed with the cord members 7 and 8 made of a elastic material and the loop element 6 or 6′ would then be of a non-elastic material. Other means of attachment of the tensioning means 3 to the base portion of the device will occur to those of skill in the art and are encompassed within the scope of the present invention as set forth in the appended claims.

Figure 4:
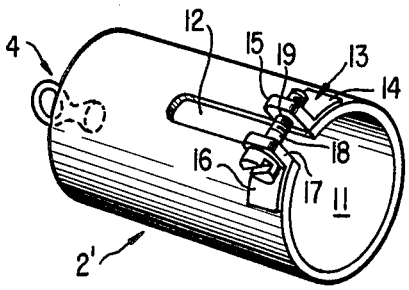
FIG. 4 is a perspective of another embodiment of the invention for use with existing and well known muscle strengtheners in the prior art.

The embodiment of the invention shown in FIG. 4 comprises principally the base portion 2′. In this embodiment, the base portion 2′ has a cup-like recess 11 extending downwardly toward the base end of the embodiment, illustratively shown as cylindrical. The attachment means 4 are illustratively shown as being similar to that in FIG. 1, but it may take the form as shown in FIGS. 2 or 3. A slot 12 is provided along the wall of the cylindrical recess 11 and closure means 13 are provided to draw the slot to a more closed position after the fore portion (not shown) is inserted into the cylindrical recess. The fore portion to be used with base portion 2′ (not shown) may be as seen at 1 in FIG. 1 or it may be any of the devices seen in the prior art as noted in the fore part of this specification. The closure means illustrated comprises a plate member 14 which extends at least part of the way around the surface of the embodiment of the base portion on one side of the slot and has an upright member 15 generally parallel to the slot. Opposite the plate element 14 is a substantially identical plate element 16 on the other side of the slot. This element extends at least a portion of the way around the surface of the base portion 2′ and has an upstanding element 17. Upstanding member 15 has a aperture 19 and upstanding element 17 has a similar aperture, not shown. Aperture 19 further may contain interior threads to receive a bolt-like member 18 which has at least a portion of its outer length threaded. It is also within the scope of the present invention to utilize a nut (not shown) to receive the threaded portion of screw 18. Means of various sorts can be provided to secure the cup to one end of the fore portion. For example, one could use an elastic or tensioning type member comprising a band with a threaded engaging member such as is well known in the art from various types of hose clamps. The cup-like member also could be attached to a fore portion member by such means as threaded elements passing through the cup-like member to engage the surface of the fore portion member.

It will be apparent to those of skill in the art that means other than slot 12 and closures therefore could be utilized to secure the base portion shown in FIG. 4 to a fore portion without departing from the scope of the invention as seen in the appended claims. Furthermore, the outer surface of the base portion 2′ may have a geometrical form other than cylindrical, i.e., rectilinear or oval. The composition of the base portion 2′ may be the same as that of a fore portion member or different.

The member A may be of various compositions. In the most simplest form, the member would be of a solid construction as shown in FIG. 1. It is important that the composition by such as to permit sterilization of the member by simple and readily available means without obstruction. The shape of the member A is not in any restricted to cylindrical. In fact, it may have the general form as shown in any of the prior art patents previously mentioned. The surface of at least the fore part of the member may be smooth or have a flesh-like texture and resilience.

Since the member of the present invention is designed to increase the muscular strength of the muscles in the vaginal cavity the use thereof would be as follows. The member A is inserted into the vaginal cavity with the user in a generally reclined position wherein the legs are in a flexed position so that the knees are above the level of the body and the feet are generally in about the same level as the body, but more or less perpendicular to the lower part of the legs. The loops of the elongated members are individually engaged by the feet of the user. The member A is inserted into the vaginal cavity and the user then begins or attempts to contract the series of muscles along the vaginal cavity in a radial, inwardly directed fashion so as to grip the member A. The user then applies an elongating force to the elongated cord-like members 7 and 8, which are attached by their respective loops to each foot, by extending the feet forwardly so as to place some tension on the elongated members. This in turn, of course, places an axial withdrawal force on the member A. By constriction of the muscles within the vaginal cavity, the user attempts to retain the member A within the vaginal cavity against the withdrawal force exercised by the elongated members. As the exercise is repeated with increasing elongation applied to the members 7 and 8, there is of course as a result provided, a withdrawal of the member from the vaginal cavity against the constrictive and retaining force applied by the sphincter type muscles. The exercise is repeated at the discretion of the user and to the extent indicated by the requirement for rehabilitation of the sphincter type muscles surrounding the vaginal cavity and at the discretion of the user.

It will be appreciated by those of knowledge in the art that the elongating requirement may be accomplished by a single elongated resilient member connected to the base of the fore portion of the member A with short non-resilient members connected thereto for engagement by the feet as previously described. Further, while the surface and texture of the fore portion of the member A are important adjuncts to the present invention, variations each are considered to be within the scope of knowledge of those working in the particular art and are not limitations to the invention set forth in the appended claims.

It will be further understood that the "Abstract of the Disclosure" set forth herein is intended to provide a nonlegal technical statement of the contents of this disclosure in compliance with the Rules of Practice of the United States Patent Office, and the "Abstract" is not intended to limit the scope of the invention described and claimed.

What is claimed is:

1. Means for strengthening muscles in a vaginal cavity comprising, in combination: a penile shaped element having a fore portion for insertion and against which said muscles are contracted as a radial force to grip said fore portion, and a base portion which remains outside said cavity; and elongated means attached to said base portion, at least a portion of said elongated means being resilient, said elongated means further having foot engaging elements on one end to tension said resilient portion to produce a controlled force of withdrawal of said fore portion, axial of said penile element, against the radial gripping force wherein said elongated means comprises a resilient member which is attached to said base portion, and a pair of non-resilient, elongated members attached to said resilient portion at one of their ends, each of said elongated members terminating in a foot engaging loop at their respevtice other ends.

2. The device according to claim 1, wherein the base portion includes an aperture at said one end thereof and through which aperture the elongated tensioning means are attached.

3. The device according to claim 1, wherein the elongated means are attached to an element which can be secured to said base portion.

4. A device in combination with means for strengthening muscles in the vaginal cavitity by constriction of said muscles in a radial pattern about one end portion of said means at least a portion of which has a penile form comprising: means having an axial recess to receive the other end portion of said means and to hold said end portion in gripping and retentive relationship therewith; elongated means for attachment to said receiving means, at least a portion of said elongated means being resilient, said elongated means further having foot engaging elements at the ends thereof removed from said receiving means to tension said resilient portion to produce a controlled force of withdrawal of said strengthening means, axially of said strengthening means, against the radial gripping force and means to attach said elongated means to said receiving means.

* * * * *